US011781787B2

(12) United States Patent
Carpenter et al.

(10) Patent No.: US 11,781,787 B2
(45) Date of Patent: Oct. 10, 2023

(54) CHILLER SYSTEM WITH DIRECT-DRIVE SWITCHED RELUCTANCE MOTOR

(71) Applicants: Reed Harmon Carpenter, Raleigh, NC (US); Donald Conrad Perry, Bellville, OH (US)

(72) Inventors: Reed Harmon Carpenter, Raleigh, NC (US); Donald Conrad Perry, Bellville, OH (US)

( * ) Notice: Subject to any disclaimer, the term of this patent is extended or adjusted under 35 U.S.C. 154(b) by 155 days.

(21) Appl. No.: 17/164,365

(22) Filed: Feb. 1, 2021

(65) Prior Publication Data

US 2022/0243959 A1 Aug. 4, 2022

(51) Int. Cl.

| | |
|---|---|
| ***F25B 31/00*** | (2006.01) |
| ***F25B 1/053*** | (2006.01) |
| ***F25B 31/02*** | (2006.01) |

(52) U.S. Cl.

CPC ..... *F25B 1/053* (2013.01); *F25B 31/002* (2013.01); *F25B 31/006* (2013.01); *F25B 31/026* (2013.01)

(58) Field of Classification Search

CPC ..... F25B 1/053; F25B 31/002; F25B 31/006; F25B 31/026; F04C 15/0023

See application file for complete search history.

(56) References Cited

U.S. PATENT DOCUMENTS

| | | | | | |
|---|---|---|---|---|---|
| 2,963,878 | A * | 12/1960 | Beggs | F25B 49/022 | 62/505 |
| 3,023,590 | A * | 3/1962 | Playle | F25B 31/026 | 62/196.3 |
| 3,738,118 | A * | 6/1973 | Jacobs | F04B 27/109 | 62/193 |
| 2004/0146414 | A1* | 7/2004 | Nichol | F04C 29/0085 | 417/410.4 |
| 2006/0250105 | A1* | 11/2006 | Jadric | H02P 25/08 | 318/701 |
| 2007/0108934 | A1* | 5/2007 | Smith | F25B 49/025 | 318/701 |
| 2009/0044548 | A1* | 2/2009 | Masoudipour | F25B 1/04 | 62/505 |
| 2010/0127585 | A1* | 5/2010 | Fee | H02K 11/40 | 310/71 |
| 2010/0284824 | A1* | 11/2010 | Hippen | F02C 6/12 | 415/110 |

* cited by examiner

*Primary Examiner* — David J Teitelbaum

(57) ABSTRACT

A 3000-20000 rpm RS-SR motor (RS-SR) and adjustable speed drive (ASD), with a cooling and lubrication system that is independent of the existing chiller lubrication and refrigerant cooling circuits. Product is configured as a direct replacement for motor, starter (drive), and gearbox solutions historically and currently used by OEM's on chillers. Oil containment and low motor cavity pressure is achieved with Axial Carbon Ceramic seals. Using an inner shell suspended in an outer shell: a coolant path is created, and vibration is abated, as well as meeting pressure vessel requirements. These features enable precise qualification of product independent of the chiller system over range of speeds and loads on a calibrated test stand. Specific information derived from qualification tests enables integration of optimization subroutines into the ASD that improve efficiency and increase ability to operate at or near compressor surge boundary.

8 Claims, 11 Drawing Sheets

| # | Description | Figures |
|---|---|---|
| 002 | Gear Box – (Typically bull gear and spur gear > 3:1 ratio) | 1a |
| 004 | Motor Starter or Variable speed Drive | 1a |
| 010 | Oil Heater and Pump for supply to gearbox and motor bearings | 1a |
| 020 | Condenser that has high pressure gas condensing to a liquid | 1a, 1b |
| 022 | Flow Regulator controls flow rate and separates high pressure from low pressure | 1a, 1b |
| 024 | Evaporator that has low pressure liquid evaporating into a gas | 1a, 1b |
| 102 | AC Power Source | 2 |
| 104 | Adjustable Speed Drive (**ASD**) | 1b, 2 |
| 106 | Test Motor and fixture to facilitate full load testing and characterization | 10 |
| 108 | Centrifugal Compressor | 1a, 1b, 2 |
| 110 | Test Coupling | 10 |
| 206 | Regulated Semi-hermetic - Switch Reluctance Motor (**RS-SR**) | 1b, 2, 10 |
| 210 | Inner Shell | 3, 5, 7, 8 |
| 211 | Outer Shell | 3, 7, 8 |
| 212 | Opposite Drive End Bell | 3, 5 |
| 214 | Drive End Bell | 3, 4, 5, 9 |
| 216 | Stator Core from laminations | 3 |
| 218 | Stator Windings | 3 |
| 220 | Bearing End Cap | 3, 5 |
| 302 | Guide Vane Assembly | 2 |
| 402 | Shaft | 3, 4 |
| 404 | Rotor from laminations | 3, 4 |
| 406 | Impeller (Wheel) | 3, 5, 9 |
| 601 | Guide vane control electrically linked to **ASD** | 1b, 9 |
| 602 | Pressure Temperature Transducer | 3,6 |
| 604 | Linear Actuator on Guide or Pre-rotation Vanes | 1b, 3, 9 |
| 606 | Metered Pumps for bearing oil supply | 3 |
| 608 | Pump for supply to chill blocks in drive it needed. | 1b, 3 |
| 610 | Heat exchanger for bearing oil and chill blocks in drive if needed | 1b, 3 |
| 612 | Compressor / Vacuum Pump to reduce motor cavity pressure | 3, 6 |
| 614 | Heat Exchanger to remove heat from super-heated gas in motor cavity. | 3, 6 |
| 616 | Check valve / pressure relief valve | 3, 6 |
| 618 | Inlet Guide or Pre-rotation Vanes | 1a, 1b, 3, 9 |
| 619 | Super heat gas bypass control valve | 3, 6 |
| 620 | Circulating super heat gas control value | 3, 6 |
| 802 | Carbon Ceramic Seal between high pressure refrigerant and oil supply (CCS) | 4,5 |
| 803 | Sleeve Bearing | 4 |
| 804 | O-ring seal between 802 and 214 | 4 |
| 805 | Snap Ring Retainer | 4 |
| 806 | Wavy Spring to preload seal | 4 |
| 807 | Secondary Labyrinth Seal | 4 |
| 809 | Carbon Ceramic Seal between oil supply and low-pressure motor cavity (CCS) | 4 |
| 810 | Wavy Spring to preload seal | 4 |
| 811 | O-ring seal between 809 and 214 | 4 |

FIGURE 11

CHILLER SYSTEM WITH DIRECT-DRIVE SWITCHED RELUCTANCE MOTOR

CROSS-REFERENCE TO RELATED APPLICATIONS

Chiller System with Direct-Drive Switched Reluctance Motor

Provisional patent Application No. 62/970,054 Document date: Feb. 4, 2020

PTAS 505901044 This document is the provisional patent for the utility patent being submitted.

Application of a Switched Reluctance Motor Control System in a Chiller

Publication Number: US 2007/0108934 A1 Publication Date: May 17, 2007

This document is a relevant document that addresses the benefits of a Chiller system that uses a Switch Reluctance motor and drive. Conceptually it is an extension of past practice that basically switches an induction motor and VFD for a Switch Reluctance motor and Switch Reluctance drive. Generally, this document identifies benefits of using Switch Reluctance technology, but fails to identify an effective methodology to implement.

Oil-Free Liquid Chiller

Publication Number: U.S. Pat. No. 6,564,560B2 Publication Date: May 20, 2018

This document has an excellent description of how the chiller system works and the benefits of an oil free system. Detailed discussion of how oil free system is built and the complex controls that the system requires to assure reliability of bearings lubricated with liquid refrigerant.

Note: RS-SR Motor/Drive system described in this document uses bearing oil, but separates the circulating oil from the chiller refrigeration circuit. This yield nearly the same benefits with much less complexity.

BACKGROUND OF THE INVENTION

The RS-SR Motor/Drive system described in this document will typically be used to replace the motors and gearboxes (when used) to drive centrifugal compressors used in large chillers. The system described is applicable to Original Equipment Manufacturers and Retrofit of existing installed chillers by any capable HVAC maintenance organization. Chillers are used to move heat to or from an enclosed area or fluid, such a building or a manufacturing process fluid. The terms OEM and OEM's will be used interchangeably to identify Chiller Manufactures.

The function of the motor and gearbox (when used) is to turn the impeller (wheel or fan) at a high speed. This action compresses the refrigerant and is essential to the "Rankin" cycle that is employed in the chiller. Gearboxes (002) are typically a large bull gear driving a small spur gear to yield an RPM speed increase. The increase is typically greater than 3:1. The system in this proposal will eliminate the gearbox in these applications. Note: Although one benefit of this system is the elimination of the gearbox, it has significant benefit for centrifugal compressors that do not use a gearbox. Problems related to gearboxes are eliminated with this system.

A chiller is a heat pump that removes heat from one location and puts it in another location. The more heat it can move with a given amount of power supplied to the motor, the more efficient it becomes. It is imperative to reduce motor losses to the most cost-effective level and move remaining losses to areas that have minimal impact on the chiller's overall efficiency rating. Heat is energy and a heat pump can move much more energy than it uses. Problems with actively optimizing system to changing conditions are corrected with this system.

There are currently two primary types of motor (and gear) systems used to drive centrifugal compressors: a Special Purpose Semi-hermetic Motor (SPSM) and a Commodity motor that may be in any number of commercially available configurations such as TEWAC, TEFC or ODP. The RS-SR Motor/Drive System combines the specific advantages of both these motors, with additional benefits to be listed.

The Special Purpose semi-hermetic motor is supplied to the Chiller manufacturer in pieces. The motor manufacture will supply a rotor on a shaft with a wound stator core. The stator core may come with or without a shell dependent upon the OEM's preference. The remaining parts required to make a functional motor are supplied by the OEM and assembled so that there are no leak paths around the turning shaft to the atmosphere. This construction has the benefit of reducing or eliminating refrigerant leaks that may have detrimental effects on the environment. It also provides a protected environment for the motor to operate in. It is the OEM's responsibility to design a solution that incorporates the supplied rotor and stator. Problems that are improved or corrected using the proposed RS-SR Motor/Drive include:

- SPSM is cooled by injecting liquid refrigerant into the motor cavity. This:
  - Increases the fluid drag losses of the rotor because it is turning in a high-density liquid environment. This reduces the motor efficiency. Problem eliminated.
  - Reduces the chiller system capacity, because the motor losses are absorbed by the circulating refrigerant, reducing the capacity of the chiller and decreasing efficiency. Problem reduced.
  - Adds large cost to prequalify a motor design; because it must be built into the chiller and the motor cooling scheme tested verified under all projected load conditions. Problem eliminated.
  - The cooling scheme results in wide variations in motor temperature and the hot spot must be identified for locating temperature sensors in the prequalification steps. This wide variation results in significant differences in differential expansion of motor materials, that result in insulation failures, that cause electrical failures of the motor. The largest differential tends to be from the bottom of the motor to the top as the excess liquid refrigerant tend to pool in the bottom. Problem eliminated.
  - The cooling scheme results in liquid refrigerant in the motor cavity that will collect in rotor voids. This will result in rotor imbalance that causes the motor to vibrate. Problem eliminated.
- SPSM uses a non-contact radial seal that has a leak path from the impeller side of the motor end bell to the motor side of the end bell. This makes it nearly impossible to reduce the pressure in the motor cavity below the pressure on the impeller side of the motor end bell.
  - The shaft must be rotating at high velocity to reduce leakage rate. This makes the seal prone to increased leak rates when the rotational speed of the shaft is reduced. Problem eliminated.
  - Seal does not prevent leaks if the rotor is not turning. Problem eliminated.
  - If clearance is reduced to reduce leak rate the risk of an intermittent seal rub on one side of the shaft is created. This will result in a localized hot spot on the shaft that causes a shaft deflection. The shaft deflection will result in an increase in shaft vibration. High shaft speed exponentially increases the magnitude of this problem. Problem eliminated.

SPSM typically uses oil to lubricate the bearings. This oil will migrate from the bearings and motor cavity to the primary refrigerant circuit in the chiller. The oil will degrade the capacity and efficiency of the chiller system. Problem eliminated.

SPSM is granted an exception to DOE requirement for 1E4 motor performance. This exception is granted for two reasons:

It is essentially impossible to accurately quantify the performance characteristics of a SPSM in the application. Problem eliminated.

The unquantified losses resulting from fluid drag losses make it very unlikely that any highspeed motor placed in the SPSM operating environment would meet 1E4 requirements. Problem eliminated.

Replacement of existing (Retrofit) with an upgraded motor technology into an existing chiller is nearly impossible:

Motor must be of same size and rating; with design compatible with existing chiller cooling and temperature control scheme as approved by OEM. Problem reduced.

Motor manufacturer must still be in business and able to supply product. Problem reduced.

Removal of the stator core and rotor assembly requires major tear down of the existing OEM chiller to facilitate repair. Problem eliminated.

Motor products are a specialty item and may not be available with a short lead time. Problem reduced.

Upgrading an existing system to make significant performance improvements require exchange of most of major components shown in FIG. 1*a*. Problem reduced.

SPSM testing is not complete and published values are estimates not measured values.

The motor assembly is not complete until the chiller is built; and it is not possible to make precise measurement in that configuration. Problem eliminated.

Lacking accurate test information to correlated with information from the motor control, precise control of guide or pre-rotation vanes is not as effective as needed. Problem eliminated.

SPSM testing requires the motor components that have never been mated be assembly into the OEM's chiller system before they are tested, therefore:

The performance is not tested until it is used in the chiller, because it is dependent upon chiller for cooling and support structure. Problem eliminated.

The conventional special purpose semi-hermetic motor must be tested at all possible chiller load conditions to assure variations in chiller load do not adversely affect cooling schemes. Problem eliminated.

The conventional special purpose semi-hermetic motor requires a prototype "throw away motor" with many temperature sensors to map temperature distribution and plan location of in production temperature sensors. Problem eliminated.

The result is high cost to evaluate motor performance, with large inaccuracies in the estimates of motor performance. Problem eliminated.

The SPSM housing temperature is frequently lower than the dew point. This causes moisture to condense on the outside of the housing and:

Moisture may collect around the power leads of unit causing arc flash between the terminals. Problem eliminated.

Moisture will collect on the OD of the housing causing wet spots in the equipment room and oxidation of the motor shell. Problem eliminated.

An additional layer of insulation is often needed over the shell to reduce the risk of condensation. Problem eliminated.

Variable speed control with this product is typically accomplished using a VFD.

Motor efficiency is reduced using this technology because the motor is designed for a specific line frequency and load. Problem eliminated.

Accurate knowledge of speed, torque and power is compromised by slip between stator and rotor. Therefore, motor performance information relative to a measured time interval lacks precision. Problem eliminated.

The motor and drive are not tested as a mated pair, the specific efficiency over the range of load conditions on the shaft is unknown. Problem eliminated.

A Commodity motor is supplied to the OEM: fully assembled, fully tested, and would have the output shaft coupled to the input of a gear box. As received by the OEM it is a functional motor. The cooling system for the rejected heat from the motor does not rely on the chiller system to function. This type of motor can typically be sourced from multiple motor manufacturers and is used for purposes other than chiller applications.

The volume of this motor product is typically two to three times greater than a SPSM. Problem reduced.

Rejected heat is typically dumped into the equipment room where the motor, condenser and evaporator are located. This can cause a significant temperature rise in the equipment room. Problem eliminated.

There is a potential leak path past the gearbox seals that would allow refrigerant to vent into the atmosphere. Problem eliminated.

The primary medium for removing heat from the motor is air circulating around the internal components. The motor must be designed to limit the temperature of these surfaces. Problem reduced.

The motor frame is exposed, and the motor must be designed to limit the temperature of the surface for safety reasons. Problem eliminated.

The motors need significant surface area to transfer heat to the circulating area resulting in an increase in volume. Problem reduced.

Units are subject to bearing oil leaks that may collect on the internal parts of the motor. The oil then tends to collect particles from the internally circulating air causing a buildup that compromises the cooling of the motor and puts it at risk of failure. Problem eliminated.

Oil loss from the bearing in these products is not recoverable and the bearings require significant maintenance attention to reduce the risk of failure. Problem reduced.

Variable speed control with this product is typically accomplished using a VFD.

Motor efficiency is reduced using this technology because the motor is designed for a specific line frequency and load. Problem eliminated.

Accurate knowledge of speed, torque and power is compromised by slip in between stator and rotor. Therefore, motor performance information relative to a measured time interval lacks precision. Problem eliminated.

Since the motor and drive are not tested as a mated pair the specific efficiency and load conditions on the shaft lack the resolution to make intelligent control decisions. Problem eliminated.

These motors tend to be louder than the SPSM. Problem eliminated.

RS-SR product has been developed for the chiller market. The products developed have exchanged an SPSM type motor for a RS-SR motor resulting in issues that need to be addressed to facilitate a practical product. Motors mounted directly into the motor housing as a conventional SPSM will:

Transmit excessive noise into the equipment room and may generated resonate vibrations that excite the building structure it is installed within. Problem eliminated.

Have high fluid drag losses from the rotor turning in a dense low temperature liquid and vapor environment. Problem reduced.

SUMMARY OF THE INVENTION

This invention relates to a RS-SR motor/drive, external electronic controller, a custom-designed carbon-ceramic axial seal and other components shown in FIG. 3. The system solves the following problems:

1. Eliminates speed increasing gearing and associated lubrication requirement.
2. Eliminates oil mixing with refrigerant.
3. Prevents loss of refrigerant to the atmosphere.
4. Gasses circulating in the motor cavity are a superheated gas, regulated at a reduced pressure and an elevated temperature, that reduce fluid drag losses of rotating rotor.
5. Reduces the size of the chiller motor by 50% and thereby makes possible mounting of the drive controller on the chiller thereby saving floor space.
6. Abates acoustical noise associated with RS-SR motors, by using shell in a shell construction formed by the inner and outer shell.
7. Facilitates the removal of motor losses into a coolant circulated through a convoluted path between inner and outer shell.
8. Cooling circuit enables full load IEEE type performance testing uncoupled from the chiller. This includes full characterization of motor and drive over complete speed and torque range.
9. Provides accurate power, speed, and efficiency information that is used to control position of guide vanes or similar chiller accessories that have a direct impact on chiller system efficiency.
10. Axial seals are a contact seal that mate with a shoulder on the shaft in a location that has minimal run out and minimal impact from heat generated by seal contact. This minimizes leaks past the seal.
11. Reduces risk of shaft vibrations caused by seal rubs.
12. Uses predictive logic to activate superheated gas cooling circuit based on real time load conditions, thereby reducing losses at part load conditions.
13. Uses predictive logic with for quadrant control of motor to adapt to rapidly changing load conditions on the output of the motor shaft.

BRIEF DESCRIPTION OF THE DRAWINGS

FIG. 11 illustrates a "Reference Numeral" table listing elements referenced in specification.

REFERENCE NUMERALS

Figure 1A:
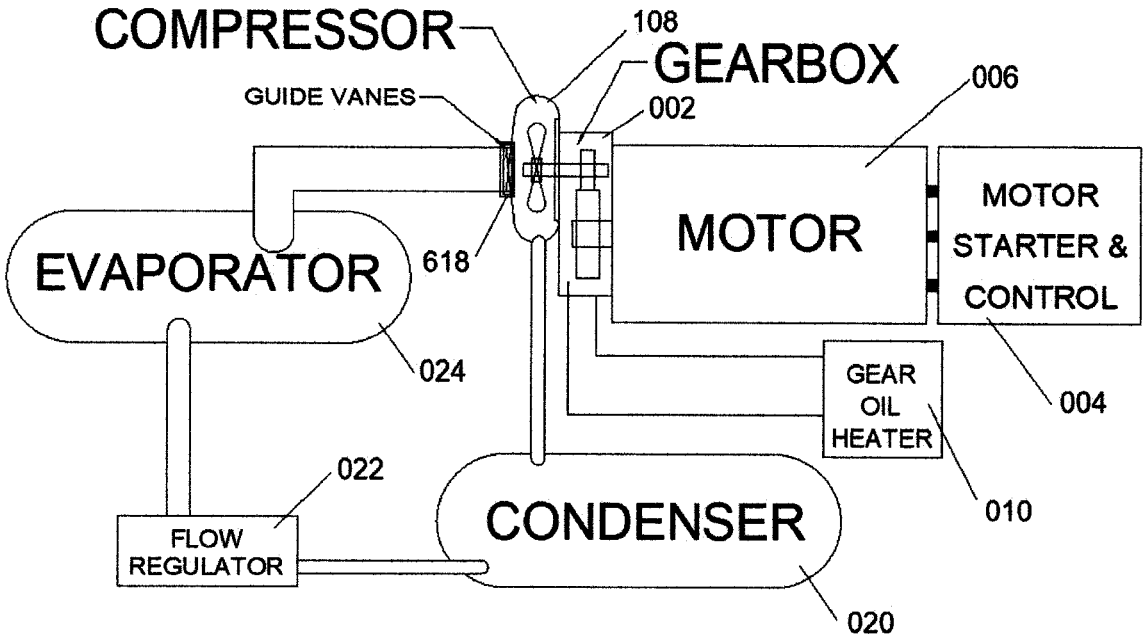
FIG. 1*a* illustrates existing technology in the typical configuration using a gearbox to increase the speed of the shaft connected to compressor impeller (or wheel).

Refer to FIG. 11 in Drawings file.

All numerals defining features are three digit and bracketed as shown "(###)". A list of features is referenced the brackets will be at each end of the list "(###, ###, & ###)"

Definitions

Environmentally—when used in conjunction with "controlled" in this document means the pressure and temperature inside the motor cavity is regulated to the lowest safe pressure level that does not exceed a temperature that would put the motor winding or bearing oil at risk. The limit would base upon lower of the insulation class of windings and or breakdown temperature of the bearing oil.

Qualified—when used with reference to test means the insulation system used in the motor has materials that have been tested to assure compatibility with the fluids being moved by the compressor. A typical test method to verify qualification might be UL 984a.

"RS-SR" is an acronym for "Regulated Semi-hermetic—Switch Reluctance" for clarity.

"CCS" is an acronym for "Carbon Ceramic Seal" with a coefficient of friction less than 0.15 and a wear life greater than 20 years at 50 meters per second and contact surface load of 0.4 mpa.

"Motor Cavity"—the enclosure formed by the assembly of: the inner shell (210), opposite drive end bell (212), drive end bell (214), seal and shaft (802, 804, 806, 805, 402) and bearing end cap 220.

Impeller Cavity—the space in the enclosure that contains the impeller that has a pressure that is not exceeded in the motor cavity. Space on impeller side of drive end bell as labeled in FIG. 3.

Description of the Preferred Embodiments

Figure 3:
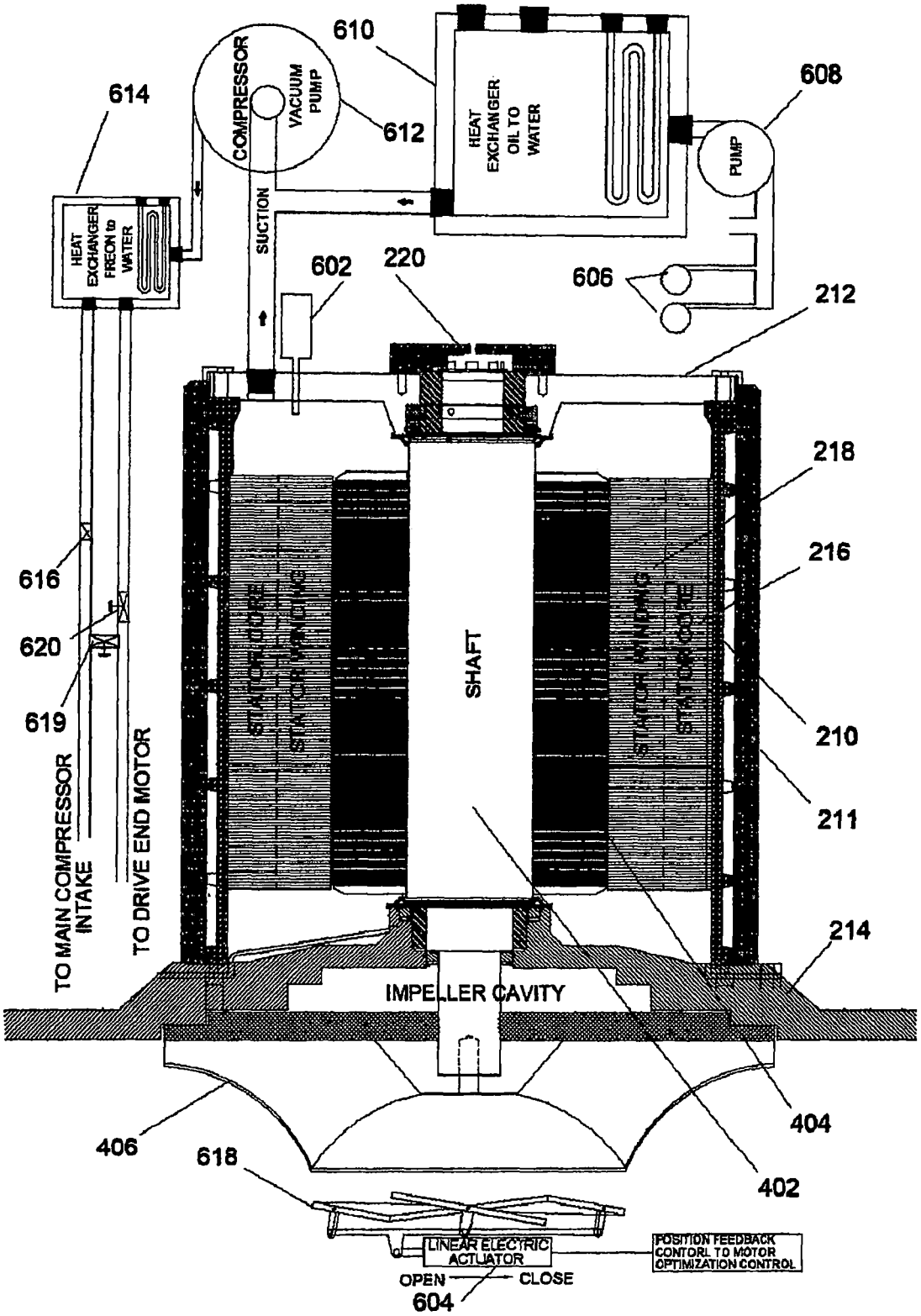
FIG. 3 illustrates regulated, Semi-Hermetic, High-Speed Switched Reluctance Motor with Semi-isolated Cooling and Lube System.
Figure 7:
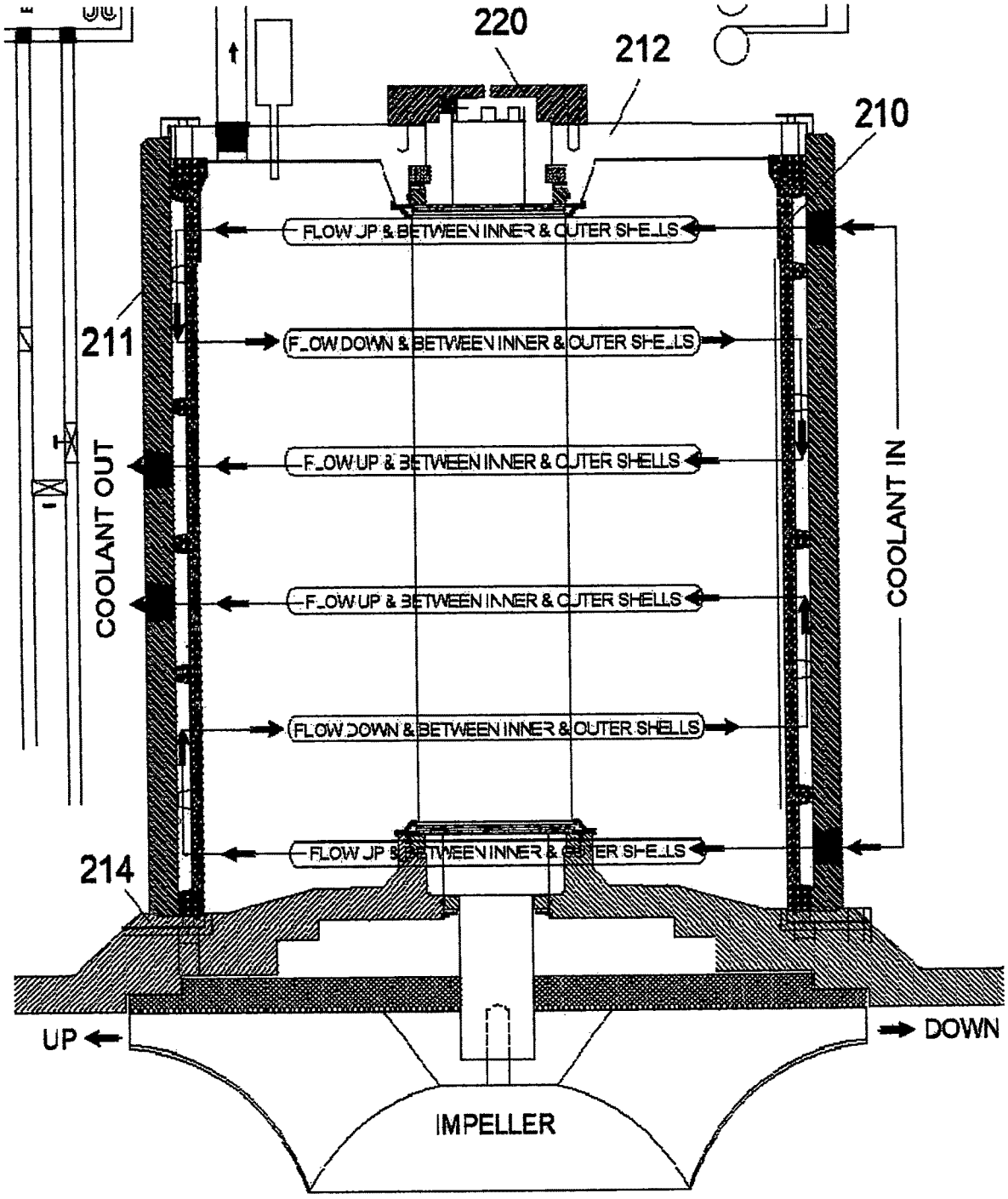
FIG. 7 illustrates the relationship between the inner and outer shells of the motor. A typical coolant flow path is also described.
Figure 8:
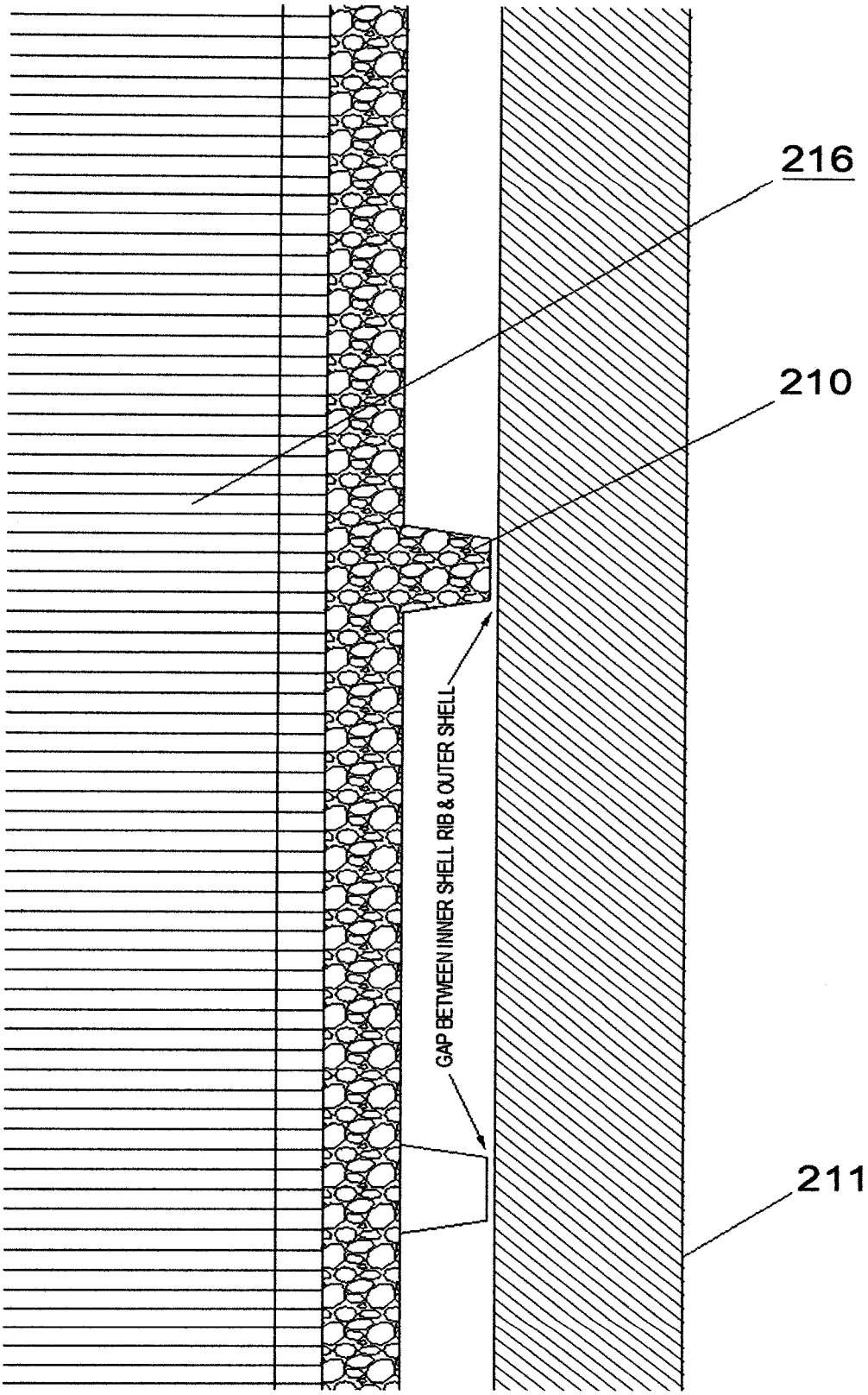
FIG. 8 illustrates the designed gap between the inner and out shell.

The preferred embodiment of the RS-SR motor is as illustrated in FIG. 3, using "shell-in-a-shell" construction. Coolant is forced to circulate between the two shells (210 & 211) and around the shell circumference thereby removing motor losses as illustrated in FIGS. 7 & 8. The coolant at elevated temperature is pumped to a heat exchanger (614) thereby keeping rejected heat outside the equipment room. Primary heat removal path for losses in the rotor are down the shaft (402) and into the impeller (406). Auxiliary cooling, when needed, is provided by introducing superheated gas into the drive end of the motor and extracting hotter superheated gas from the opposite drive end of motor cavity (602), (612), (614), (619), (620). FIG. 3

Figure 5:
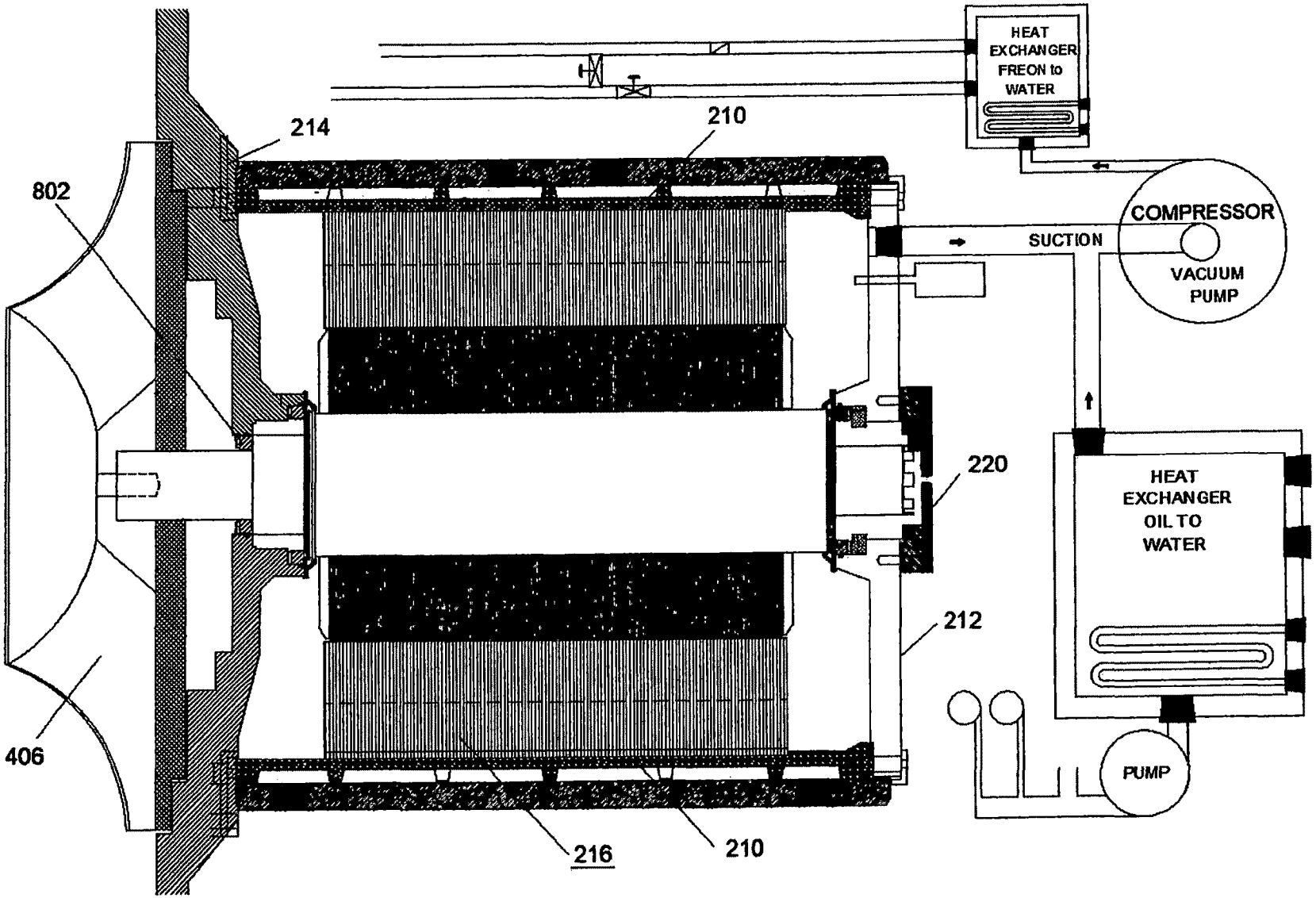
FIG. 5 illustrates a typical assembly with the impeller attached to the drive end of the shaft. The objective of the figure is to demonstrate that the motor cavity is a contained environment separate from the refrigerant around the impeller and the ambient atmosphere outside the motor.

End bells on both ends of the motor (212, 214 & 220) in conjunction with inner shell (210) form a pressure vessel to prevent refrigerant loss in the event of seal failure. FIG. 5

Outer shell (211) seals on both ends of inner shell (210) yielding a sealed coolant cavity; this allows any fluid with sufficient specific heat to be used as a motor coolant. (For example: heat losses may be carried off in the cooling tower wall instead of the working refrigerant as in traditional semi-hermetic motor. This will improve chiller system efficiency.) FIG. 7

Figure 1B:
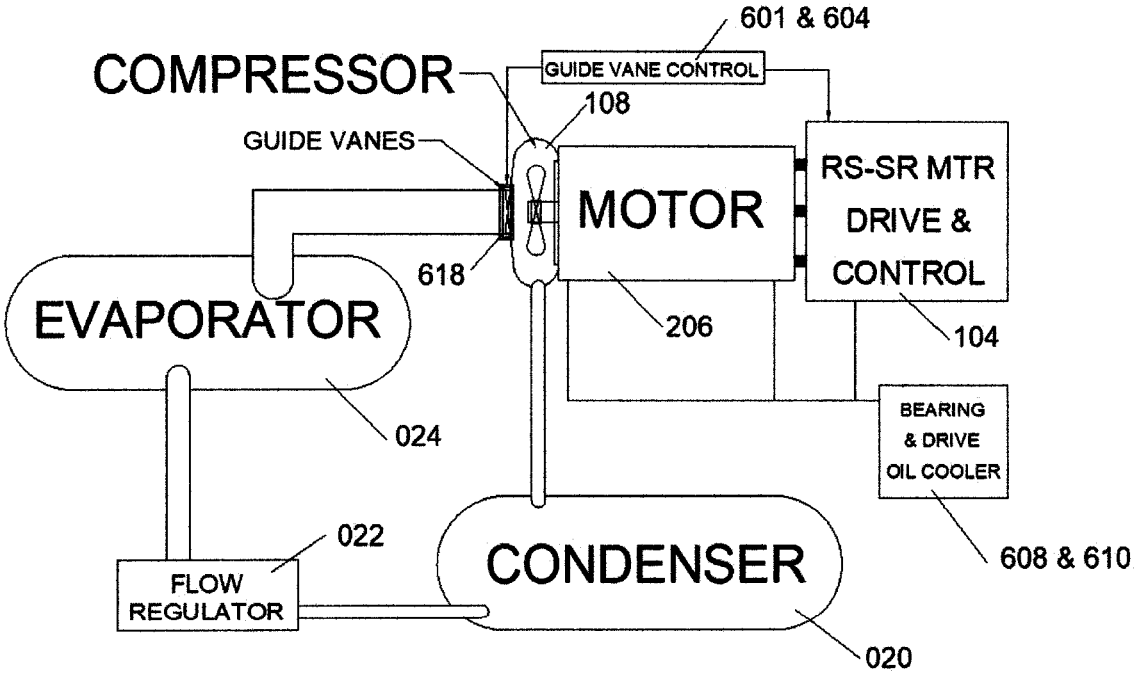
FIG. 1*b* illustrates proposed system that uses a direct drive RS-SR motor and drive system, with no gearbox, reduced footprint and typical control loop shown.
Figure 2:
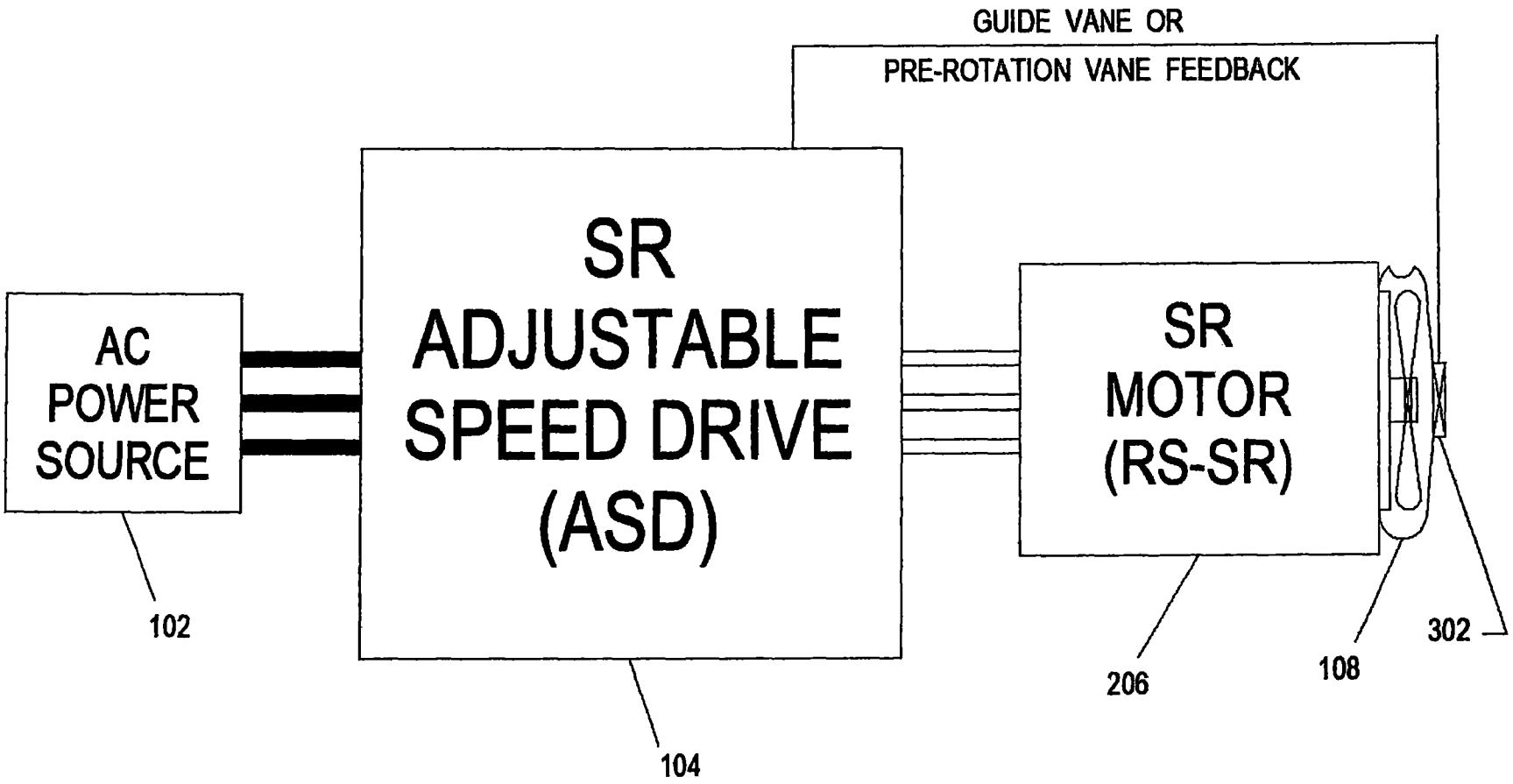
FIG. 2 illustrates RS-SR motor Drive and Control Box
Figure 9:
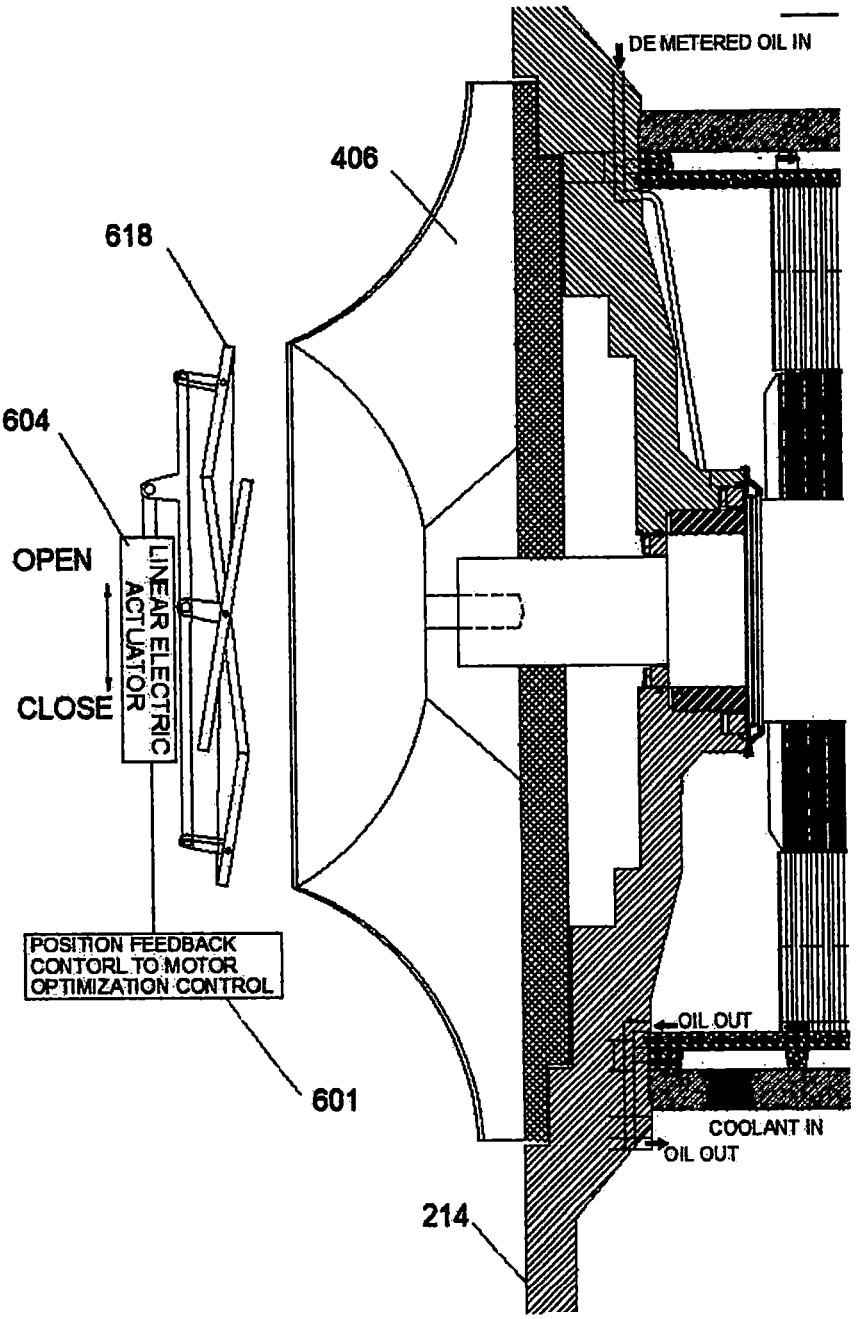
FIG. 9 illustrates the major components needed to facilitate control of guide vanes (or pre rotation vanes) in conjunction with ASD interface.

The preferred embodiment of the RS-SR drive is two-level topology as shown in FIG. 1*b* & 2; with electronic feedback loops to control chiller system behavior and efficiency(618, 601 & 604). (For example, the Guide Vanes.) FIGS. 1*b*, 3 & 9

Figure 4:
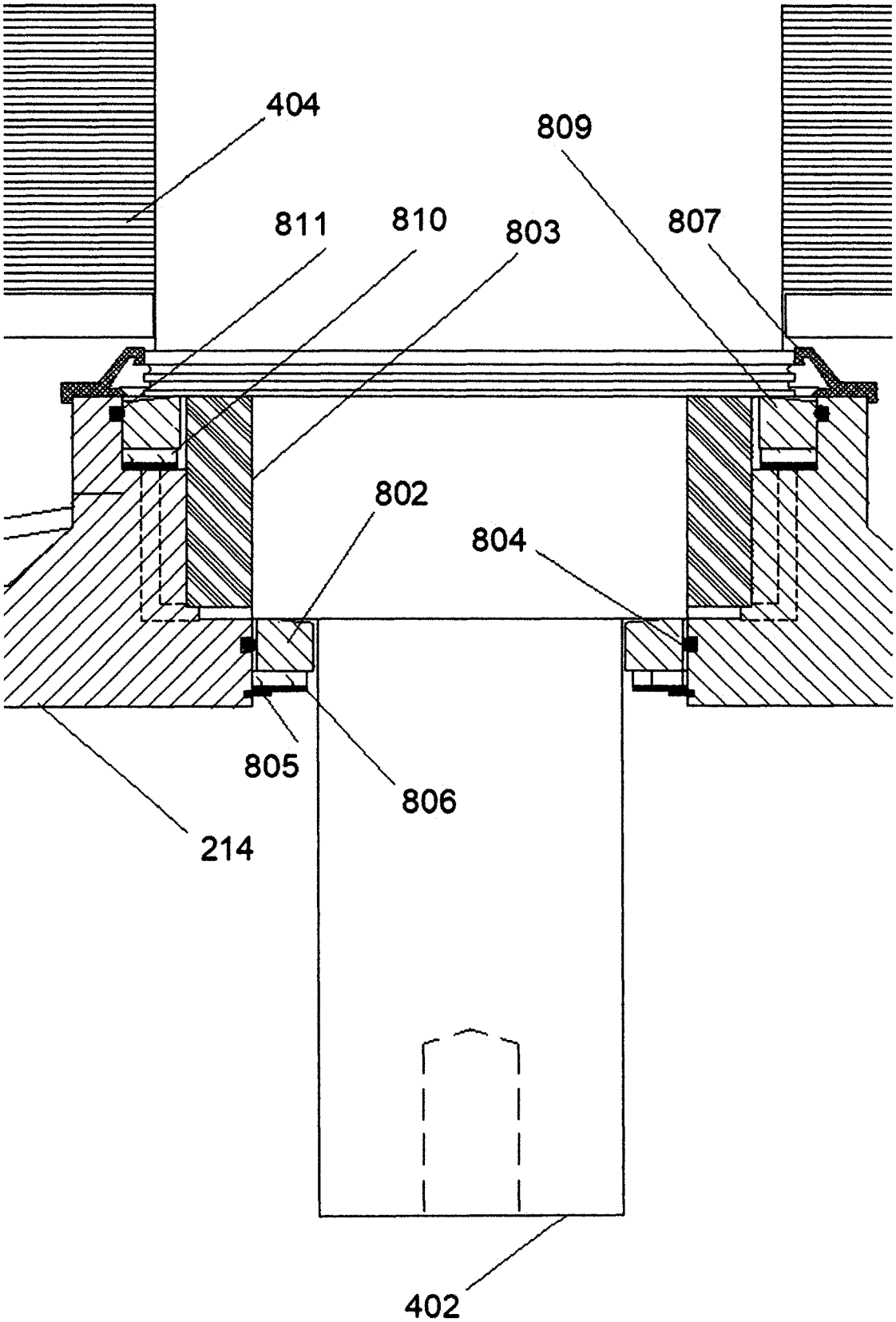
FIG. 4 illustrates typical Carbon Ceramic seal configuration being used to separate compressor operating environment from the RS-SR motor operating environment.

As shown in FIG. 4 & FIG. 5 high pressure gas on the Impeller (406) side of the "Drive End Bell" (214) pushes the carbon ceramic seal (802) into the axial sealing surface of the shaft (402). A second ceramic seal (809) on the inboard side of the "Drive End Bell" (214) creates a second bearer. Both seals are pre-loaded (806 & 809) to assure the seal fit does not become a leak path. The enclosure formed by both end bells (212, 214 & 220) and the "Inner Shell" (210) is a reduced pressure area at less than one atmosphere, but it also has significant strength to prevent a burst failure if the seals should fail.

Figure 6:
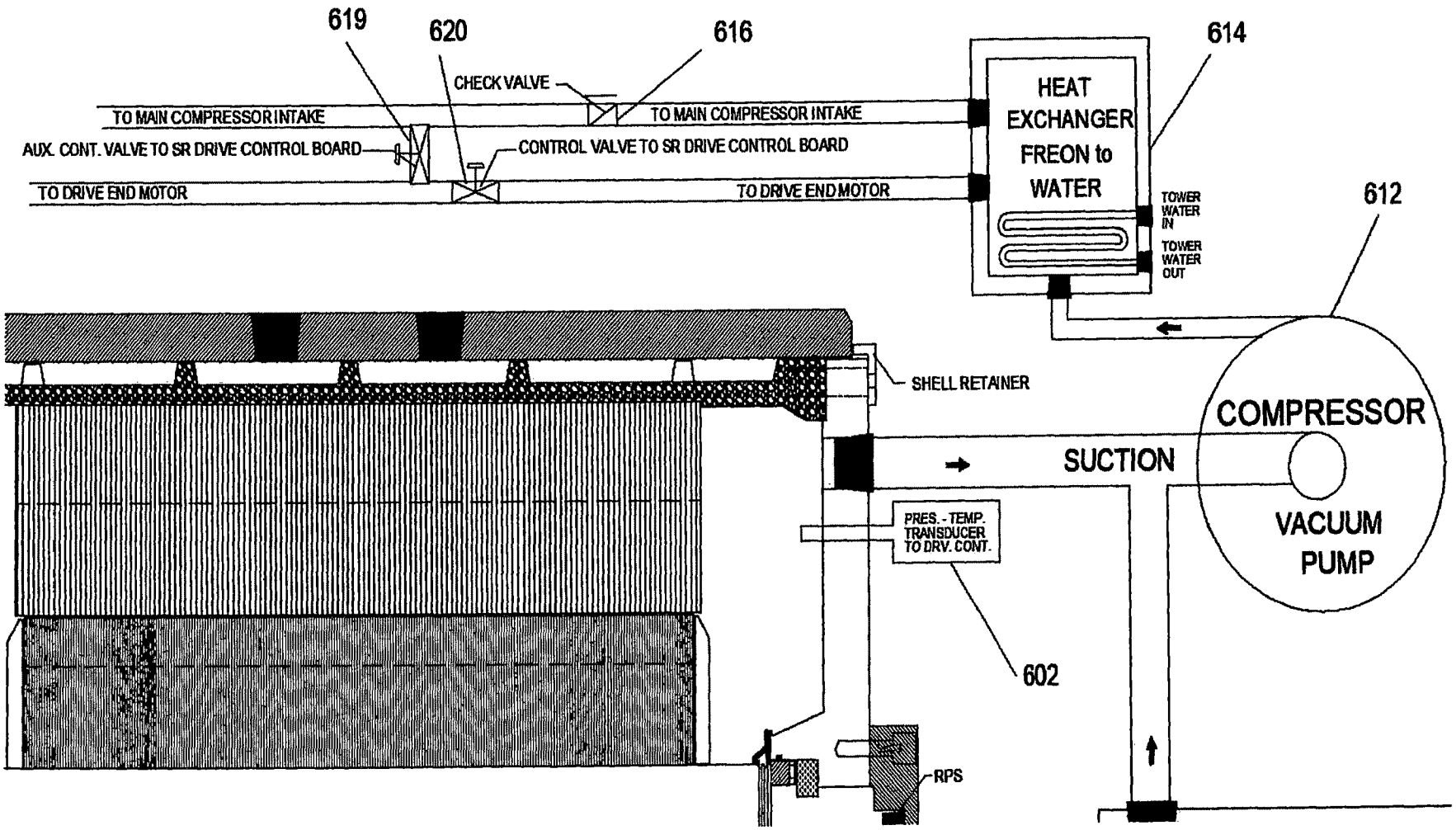
FIG. 6 illustrates a method of regulating the pressure and temperature in the motor cavity.

FIG. 3 & FIG. 6 show how the motor cavity temperature and pressure is controlled using small variable speed compressor acting as a vacuum pump (612) too: circulate superheated gas, reduce pressure in motor cavity, degas oil circulating in the bearing of the motor.

Conventional semi-hermetic special purpose motors have liquid refrigerant dumped into the motor cavity and allow the spinning rotor to throw the liquid refrigerant around the inside of the unit. This requires hundreds of hours of qualification testing to identify potential hot spots to place the motor temperature sensors. The net result is typically a temperature gradient that easily varies by 100 degrees C., dependent upon where on the motor the temperature is measured. (The primary cooling path is through OD of the stator and supplemented by superheated gas in the motor cavity as needed. This yields smaller predicable gradients in the motor windings, which are the primary risk.)

The result of conventional practice is significant fluid drag losses on the motor, that reduce the motor efficiency particularly at part load where the fluid drag losses stay near constant and reduce the power out to power in ratio.

The described system in "FIG. 6" eliminates liquid refrigerant in the motor cavity and uses only superheated refrigerant in the motor cavity.

This minimizes the range of temperatures in an operating unit, thereby reducing stresses on the motor windings caused by differential expansion.

Yields a lower viscosity medium for the rotor to rotate in, increasing efficiency.

FIG. 7 & FIG. 8 shows a shell-in-a-shell (210 & 211) construction provides a controlled cooling fluid path. FIG. 7 shows the ribs on both ends of inner stator shell (210), adjacent the end bells (212 & 214), are near line to line contact to facilitate a fluid seal and maintain a gap between inner (210) and outer (211) shells at the center rib locations as shown in FIG. 8. (In this example there are 5 center ribs.) FIG. 8 shows the gap between inner shell rib (210) and the outer shell (211) that reduces vibration transmission from stator core (216) to outer shell (211), making the unit much quieter. The ribs on the OD of the inner shell (210) shown in FIG. 7 serve the functions of:

Stiffening the Inner Shell.

Forming a convoluted path that facilities uniform heat removal.

Increasing the surface area for removal of heat.

FIG. 9 shows a linear actuator (604) with a position feedback loop (601) to drive controller (104) that enables "on the fly tuning" of "Guide Vane" (618) position to maximize efficiency of chiller system. Possible because precise speed, torque and efficiency of the motor is always known and the response time is reduced to microseconds. FIG. 2 shows a simple feedback loop between actuator (302) and ASD (104).

FIG. 6 shows a sensor inside the motor cavity with a feed through (602) that communicates the current pressure and temperature conditions electronically to ASD (104). The ASD (104) then sends control information to the "Compressor/Vacuum pump" (214) to regulate the internal pressure and temperature.

The ASD (214) sends control information to the "Control Valves" (619 & 620) to regulated flow of refrigerant into the motor cavity, thereby controlling motor temperature. The ASD optimizes temperature and pressure to maximize motor efficiency and assure motor life.

Check Valve (616) opens to relieve excess superheated gas pressure and vents to compressor inlet.

Control Valve (620) releases to allow flow of superheated gas through motor cavity.

Control Valve (619) releases to provide supplemental superheated gas to the pressure to motor cooling circuit if needed.

FIG. 3 the "Compressor/Vacuum pump" (612) assure bearing oil is degassed. Heat exchangers (610 & 614) are used to remove heat (motor losses) refrigerant circulating in motor cavity and the oil circulating in the bearings.

Figure 10:
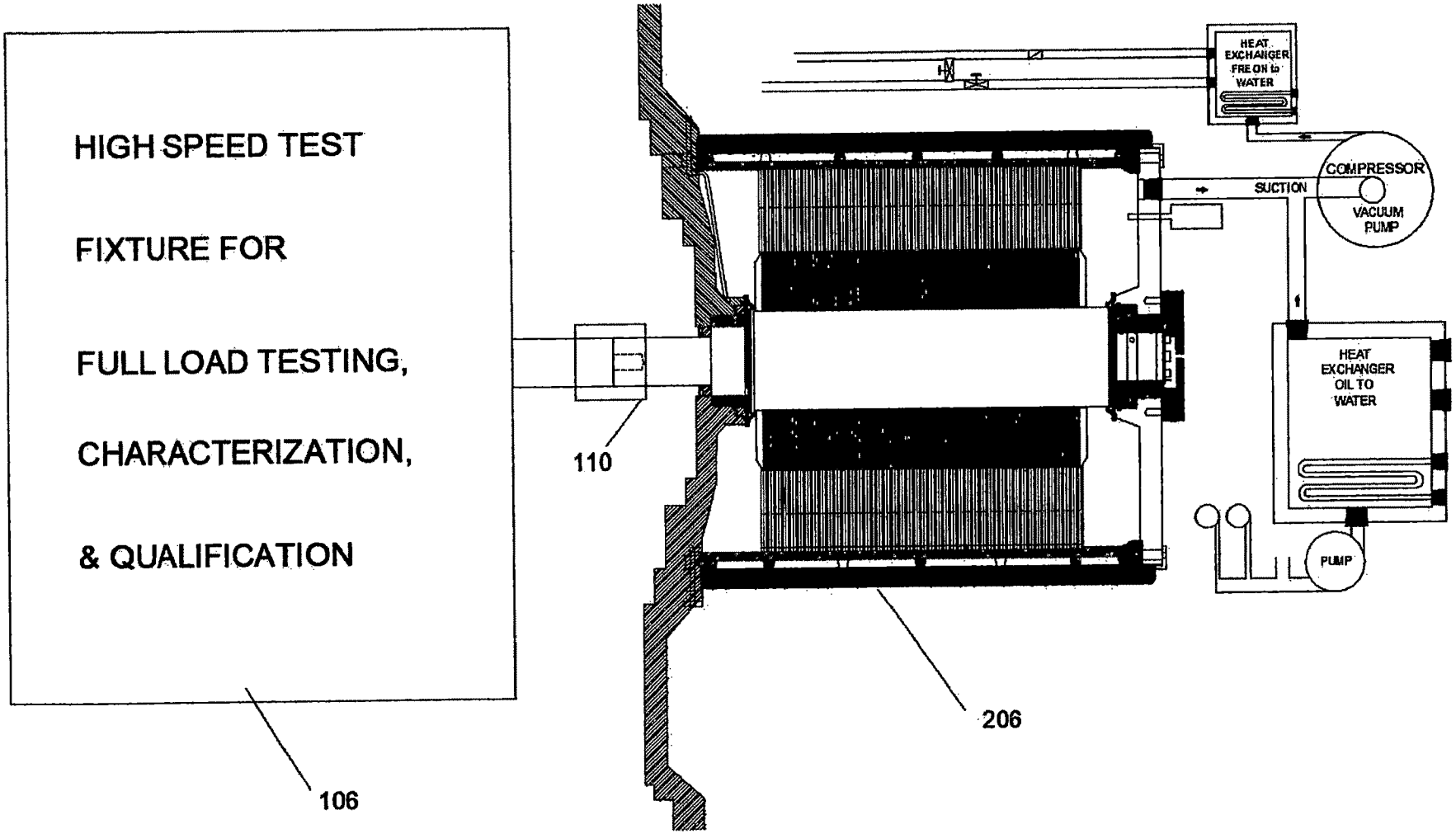
FIG. 10 illustrates a test configuration to facilitate full load testing and characterization of motor and drive.

FIG. 10 shows a simple test configuration like that used with a Commodity ODP, TEWAC or TEFC motor. Proposed RS-SR Motor Drive system makes full load testing of motor possible; there is no need for the chiller system components to support its operation, when completing a battery of standard tests.

CONCLUSION

The RS-SR motor drive system is an evolution of the drive and motor used for centrifugal compressors. The product is manufactured as a direct replacement of motors and gearboxes yielding greater than 33% improvement in chiller efficiency over conventional motor and wye delta starters. (Greater than an 8% improvement over conventional motor and VFD systems.) The product is pre-tested and qualified to perform on legacy products and new OEM equipment.

Construction with axial carbon ceramic seals facilitates:

- Operating the motor in a reduced pressure environment that reduces fluid drag losses.
- Separating the sleeve bearing oil from the primary chiller circuit to improve evaporator and condenser heat transfer.
- Circulation of superheated gasses to supplement the cooling of the motor.
- Independent load testing and qualification outside conventional chiller system.

Construction with shell in a shell facilitates:

- Noise attenuation by suspending the motor core in the inner shell.
- Creation of a sealed coolant path that removes heat from the stator OD.
- Creation of a convoluted cooling path to assure effective uniform cooling.
- Creation of a sealed cavity that blocks escape of refrigerant to the atmosphere.
- Independent load testing and qualification outside conventional chiller system.

Construction with ASD and related devices facilitates:

- Predictive control of motor cavity pressure and temperature based on load.
- Control of guide vanes to optimize performance based on motor loading.
- Operation on surge boundaries utilizing capabilities of ASD and RS-SR motor.
- Precise real time measurement of motor speed and power for refinement of system control features.
- Controlled acceleration and deceleration in either direction of rotation to facilitate adaptation to rapidly changing conditions common when operating at or near surge.

What is claimed is:

1. A chiller-compressor system utilizing a direct-drive, environmental regulated, semi-hermetic, switched reluctance motor/drive system (RS-SR Motor/Drive) having pre-qualification and pretested operating parameters comprising:

a motor using an axial seal;

a stator core of said motor bonded to an inner shell; and an Adjustable Speed Drive (ASD) regulating system performance, wherein said ASD is interconnected to a check valve/pressure relief valve, a super heat gas bypass control valve, a circulating super heat gas control valve, a pressure/temperature transducer, and a liner actuator on guide or pre-rotation vanes to optimize performance and predictive control of regulated circulating superheated gases, acceleration, and deceleration.

2. The RS-SR Motor/Drive as in claim 1 said inner shell suspended on each end in said outer shell to attenuate noise transmission from said stator core to said outer shell.

3. The RS-SR Motor/Drive as in claim 1 said ASD controlling said check valve/pressure relief valve as a means to release excess pressure in a heat exchanger to compressor intake.

4. The RS-SR Motor/Drive as in claim 1 said ASD controlling a normally closed said super heat gas bypass control valve as a means of adding super-heated gas to the circulating cooling circuit in the motor cavity.

5. The RS-SR Motor/Drive as in claim 1 said ASD controlling said circulating super-heat control valve as a means of regulating the pressure and temperature in the motor cavity.

6. The RS-SR Motor/Drive as in claim 1 said ASD with said pressure temperature transducer as means to verify pressure and temperature control of the motor cavity.

7. The RS-SR Motor/Drive as in claim 1 said ASD controlling optimum position of said linear actuator on guide or pre-rotation vanes based on known torques and speed of the said RS-SR Motor/Drive.

8. The RS-SR Motor/Drive of claim 1 said ASD controlling said acceleration and deceleration in either direction of rotation, wherein enabling adaptation to torque pulsations and reverse of rotation when operating near or at a surge condition.

* * * * *